US005538492A

United States Patent [19]

Potter

[11] Patent Number: 5,538,492

[45] Date of Patent: Jul. 23, 1996

[54] CENTRIFUGE BOWL HAVING A LINE OF WEAKNESS THEREIN

[75] Inventor: Raymond G. Potter, Southbury, Conn.

[73] Assignee: E. I. Du Pont de Nemours and Company, Wilmington, Del.

[21] Appl. No.: 527,619

[22] Filed: Sep. 13, 1995

[51] Int. Cl.[6] ..... B04B 7/06

[52] U.S. Cl. ..... 494/12; 494/60

[58] Field of Search ..... 494/1, 12, 16, 494/20, 33, 43, 60, 81, 85; 210/360.1, 380.1

[56] References Cited

U.S. PATENT DOCUMENTS

| | | | |
|---|---|---|---|
| 2,447,330 | 8/1948 | Grebmeier | 494/12 X |
| 2,608,344 | 8/1952 | Pickels | 494/60 X |
| 3,111,863 | 11/1963 | Filz | 494/12 X |
| 3,129,174 | 4/1964 | Pickels et al. | 494/60 X |
| 3,990,633 | 11/1976 | Stahl et al. . | |
| 4,451,248 | 5/1984 | Williams | 494/84 |
| 4,690,669 | 9/1987 | Williams et al. | 494/14 |
| 4,693,702 | 9/1987 | Carson et al. | 494/61 |
| 4,753,630 | 6/1988 | Romanauskas | 494/9 |
| 4,753,631 | 6/1988 | Romanauskas | 494/9 |
| 5,279,538 | 1/1994 | Carson | 494/81 |

*Primary Examiner*—Charles E. Cooley

[57] ABSTRACT

A bowl for use in a centrifuge instrument wherein the bowl has a predetermined line of weakness formed therein. The line of weakness, which may be disposed on either the inside or the outside surface of the bowl, subdivides the bowl into an upper and a lower region.

8 Claims, 4 Drawing Sheets

CENTRIFUGE BOWL HAVING A LINE OF WEAKNESS THEREIN

BACKGROUND OF INVENTION

1. Field of Invention

The present invention relates to a bowl for use in a centrifuge instrument.

2. Description of Prior Art

The containment system for a centrifuge instrument includes a vessel commonly called a bowl or a chamber. The bowl is usually surrounded by a guard ring that may itself be rotationally mounted with respect to the framework of the instrument. The bowl is formed of a substantially cylindrical sidewall having a planar floor portion. An outer flange is provided about the upper edge of the bowl whereby the bowl may be rigidly attached to the flamework.

The floor of the bowl has a central axial opening therein. The shaft upon which a centrifuge rotor is received projects through the opening in the floor of the bowl. The shaft is connected to and driven by any suitable source of motive energy.

A centrifuge rotor is mechanically secured to the top of the shaft for rotation within the confines of the bowl about a rotational axis extending through the shaft. A rotor fabricated from a suitable material such as aluminum will operate at a particular performance level for a specific number of cycles. This predetermined number of cycles is usually referred to as the cycle life of the rotor. After this predetermined number of cycles is reached the likelihood of a rotor disruption occurring due to material fatigue is greatly increased. When the rotor fails the rotor fragments will impact the sidewall of the bowl with a large amount of energy.

User error may cause another form of rotor disruption. If the rotor is not securely affixed to the shaft by the user it may become disengaged from the shaft during operation and impact against the sidewall of the bowl.

The containment system of the instrument is always designed to contain the energy of impact of the rotor or its fragments (if any) and to prevent the fragments from escaping the interior of the instrument.

The energy imparted to the sidewall of the centrifuge bowl can have devastating effects. In an improperly designed centrifuge a rotor failure can cause gross instrument movement, possibly injuring personnel who happen to be located nearby. In large floor model instruments the deformation and rotation of the guard ring allows the energy imparted by the rotor into the containment system to dissipate. By allowing the guard ring to rotate the amount of energy that is transferred to the instrument framework is greatly reduced.

In some models of tabletop centrifuge instruments insufficient available space precludes the provision of a rotatable guard ring surrounding the bowl. The bowl must, therefore, function as the guard ring. A tabletop instrument has the additional problem in that it is usually light in weight, which allows greater movement in the event of a rotor failure. Due to the potential for injury resulting from a rotor failure, the performance of rotors for use in a tabletop centrifuge instrument is usually degraded both to reduce its potential energy and to extend the life of the rotor.

Accordingly, it is believed advantageous to provide a centrifuge bowl that is adapted to separate itself from the framework of the centrifuge instrument in the event of a rotor failure, reducing the amount of energy that is transferred from the rotor to the centrifuge framework, thus preventing gross instrument movement.

SUMMARY OF INVENTION

The present invention is directed to a bowl for use in a centrifuge instrument wherein the bowl has a predetermined line of weakness formed therein. The line of weakness, which may be disposed on either the inside or the outside surface of the bowl, subdivides the bowl into an upper and a lower region. The line of weakness is preferably implemented in the form of a V-shaped groove. In the event of a rotor disruption the bowl responds to a force imposed on the inside surface of the lower region (due, for example, to the impact of a rotor fragment) by separating from the upper region along the line of weakness. As a result the lower region is free to deform and to rotate to dissipate the energy of the rotor fragment. In the preferred instance the line of weakness should be formed in the bowl at a height dimension at least equal to the height occupied by the top surface of a rotor when the same is mounted on the rotor shaft.

BRIEF DESCRIPTION OF DRAWINGS

The invention will be more fully understood from the following detailed description, taken in connection with the accompanying drawings, in which.

DETAILED DESCRIPTION OF INVENTION

Figure 1:
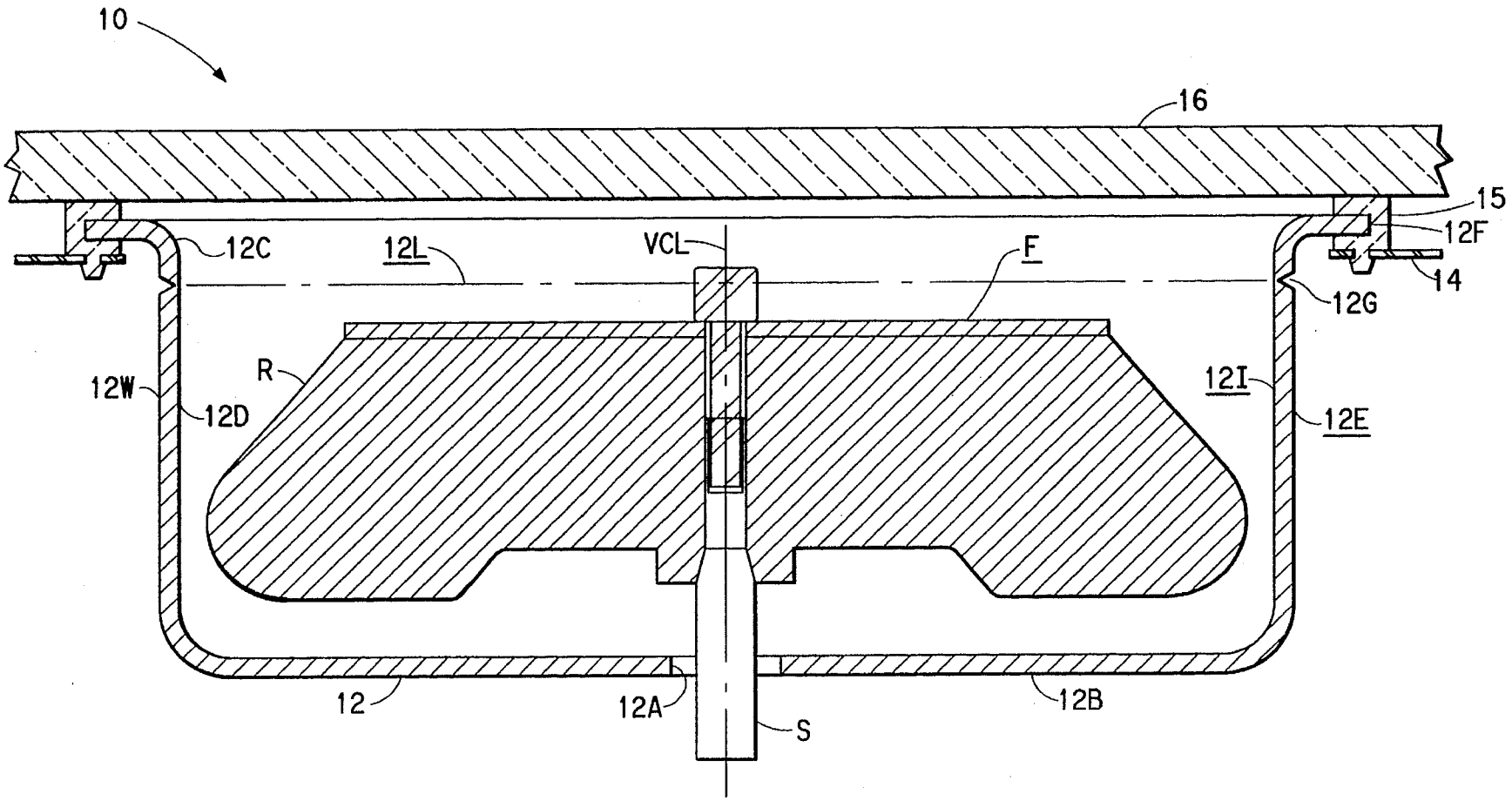
FIG. 1 is a side elevational view, substantially entirely in section, of a centrifuge bowl in accordance with the present invention.

Throughout the following detailed description similar reference characters refer to similar elements in all Figures of the drawings.

FIG. 1 shows a centrifuge instrument generally indicated by the reference character 10 having a bowl 12 in accordance with the present invention. The bowl 12 is defined by a cylindrical sidewall 12W and a bottom 12B. The bowl has an inner surface 1 21 and an outer surface 12E. A central opening 12A is provided on the bottom 12B. A rotor mounting shaft S extends through the opening 12A. The shaft S has an axis of rotation VCL extending therethrough. The bowl 12 is fabricated from any suitable material, such as aluminum.

Contained within the bowl 12 is a rotor indicated by the reference character R. The rotor R is shown as mounted to the upper end of the drive shaft S. The rotor 10 rotates on the shaft S about the axis of rotation VCL. The rotor R has a top surface F thereon.

The bowl 12 includes a groove 12G that extends circumferentially around outside surface 12E of the sidewall 12W of the bowl 12. For purposes that will become more clear herein the groove 12G defines a line of weakness in the bowl 12. The line of weakness is generally indicated by the reference character 12L. The area of the bowl 12 adjacent to the line 12L of weakness is a relatively high stressed region of likely failure in the event of a rotor disruption.

The groove 12G separates the bowl 12 into an upper portion 12C and a lower portion 12D. The radially outer portion of the upper portion 12C is out-turned to form a flange 12F. Although it can be disposed at any predetermined position on the sidewall the groove 12G is, in the preferred instance, located at a vertical position along the axis VCL equal to or greater than the top surface of the rotor R.

The bowl 12 is mounted to the instrument framework 14 through the flange 12F. This attachment can be accomplished using a number of different methods. As shown in FIG. 1 the flange 12F is clamped in a gasket 15 between the instrument framework 14 and the instrument bowl door 16. The door 16 may be formed from metal or from a transparent material (e.g., acrylic) as illustrated.

Figure 2A:
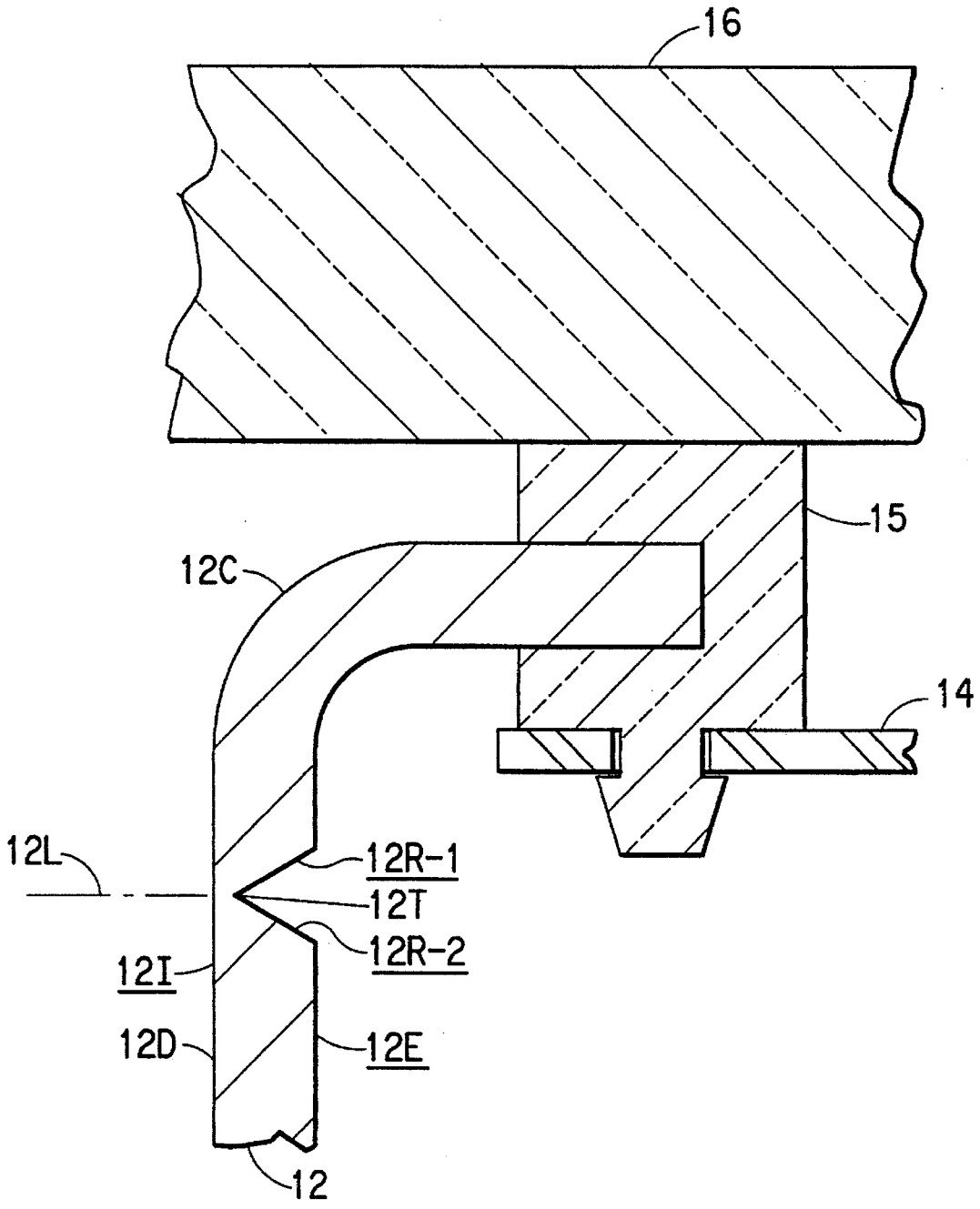
FIG. 2A is an enlargement of a portion of FIG. 1 illustrating a line of weakness in the form of a groove extending circumferentially around the outside surface of the bowl.

As is best viewed in FIG. 2 the groove 12G is defined by a radially upper surface 12R-1 and a radially lower surface 12R-2. The two surfaces intersect to form an edge 12T. The distance between the edge 12T and the opposite surface (in the case shown, the inner surface 121) of the bowl 12 represents the smallest cross section of material in the bowl 12. Although shown as V-shaped in the Figures it should be understood that the groove 12G may take any convenient cross sectional shape.

In the event that a rotor R disruption occurs during operation, since the rotor R has both a rotational velocity and a linear velocity, it will translate from the shaft S and impact on the lower portion 12D of the inner surface 121 of the bowl 12. At the point of impact the rotor R will transmit a substantial amount of energy to the bowl. This energy will have both linear (i.e., radial) and rotational components. The radial component may impact the sidewall 12W causing the bowl to deform and fail along the line of weakness 12L. The rotational component will impart a torque to the bowl wall 12W causing the bowl 12 to fail circumferentially at its narrowest cross section, that location being the line of weakness 12L defined by the groove 12G. The lower portion 12D of the bowl will separate from the upper portion 12C and will rotate within the framework 14.

The energy of the rotor is dissipated by a combination of bowl deformation and heat generated through frictional contact between the rotating lower portion 12D of the bowl and the instrument framework.

Figure 2B:
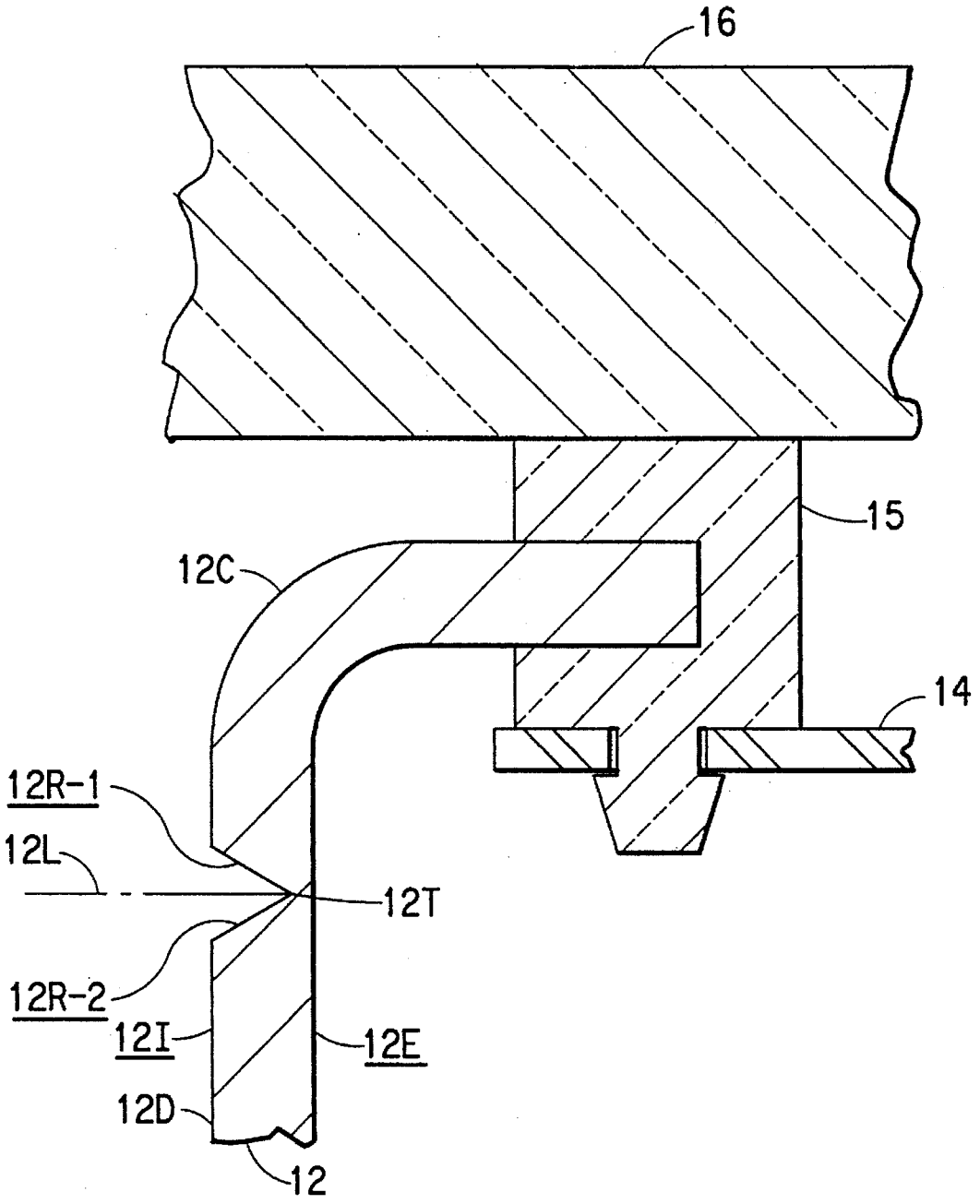
FIG. 2B illustrates a line of weakness in the form of a groove extending circumferentially around the inside surface of the bowl.
Figure 2C:
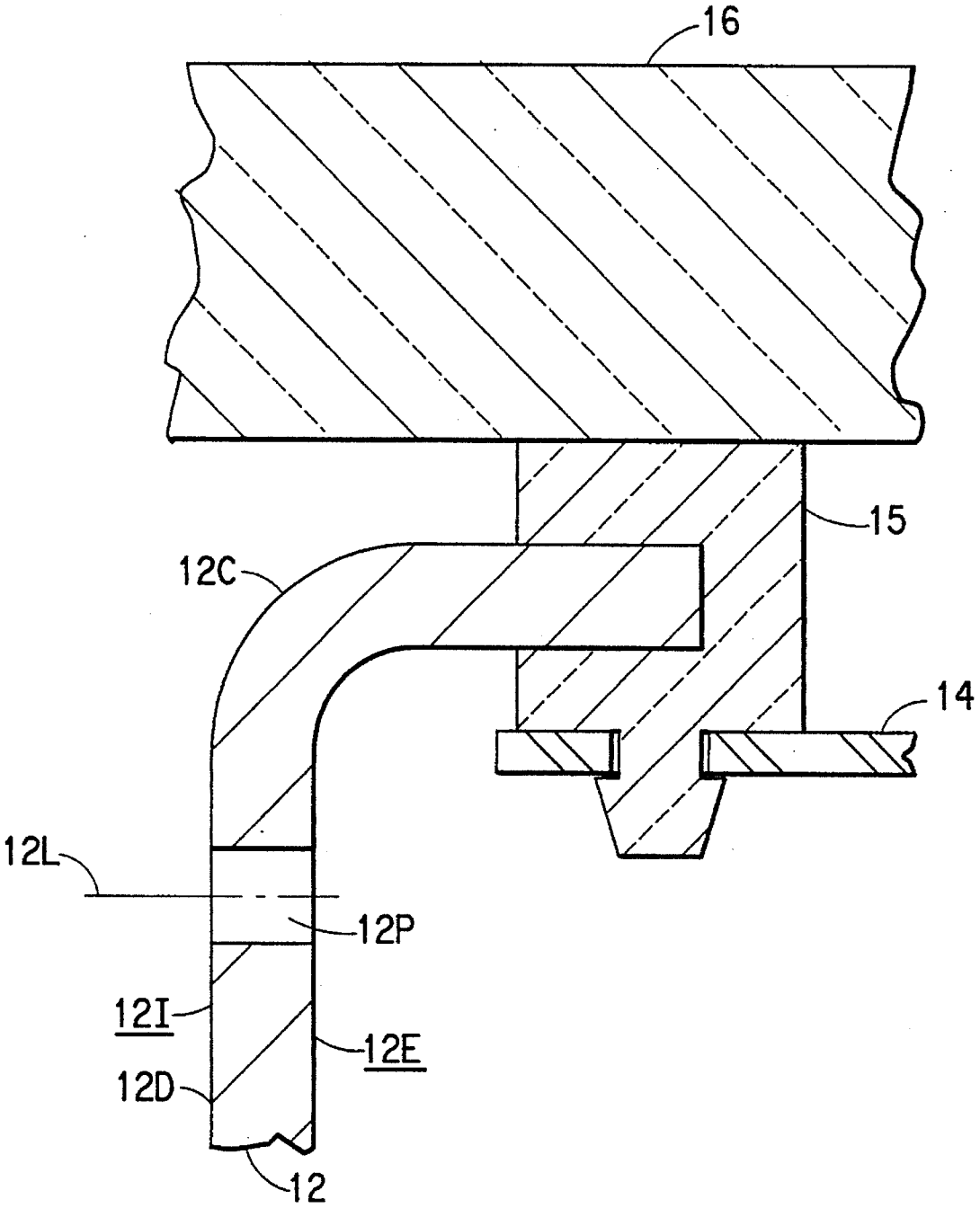
FIG. 2C illustrates the line of weakness in the form of a circumferentially extending series of closely spaced perforations.

It should be appreciated that the groove 12G could be disposed on the inner surface 121, as illustrated in FIG. 2B. In either case (FIG. 2A or FIG. 2B) the groove 12G could be circumferentially continuous, or circumferentially interrupted. It should be appreciated that 1 he line of weakness 12L could be alternatively defined, as, for example, by a circumferential series of closely spaced perforations 12P as illustrated in FIG. 2C. The perforations 12P extend completely through the wall 12W of the bowl, as illustrated, or may extend only partially thorough the wall 12W. The perforations may originate on either the inside surface 121 or the outer surface 12E.

Those skilled in the art, having the benefit of the teachings of the present invention as hereinbefore set forth, may effect numerous modification thereto. Such modifications are to be construed as lying within the contemplation of the present invention, as defined by the appended claims.

What is claimed is:

1. An open-top bowl for a centrifuge instrument, the bowl having an inside surface and an outside surface, a mounting flange extending circumferentially about the open top of the bowl for clamping the bowl to a framework, the improvement comprising:

the bowl having at least one predetermined line of weakness formed therein, the line of weakness extending circumferentially about the bowl, the line of weakness subdividing the bowl into an upper and a lower region, the bowl being responsive to a force exerted on the interior surface of the lower region by separating from the upper region along the line of weakness.

2. The bowl of claim 1 wherein the line of weakness comprises a groove located on the inside surface of the bowl.

3. The bowl of claim 2 wherein the groove is continuous.

4. The bowl of claim 2 wherein the groove is interrupted.

5. The bowl of claim 1 wherein the line of weakness comprises a groove located on the outside surface of the bowl.

6. The bowl of claim 5 wherein the groove is continuous.

7. The bowl of claim 5 wherein the groove is interrupted.

8. The bowl of claim I wherein the instrument has a central axial shaft, the shaft being adapted to accept a rotor thereon, a surface on the rotor defining a predetermined height dimension, wherein the bowl has a bottom thereon, and wherein the line of weakness is disposed a distance from the bottom of the bowl at least equal to the height dimension of the rotor.

* * * * *